US007093520B2

(12) United States Patent
Tuanmu

(10) Patent No.: US 7,093,520 B2
(45) Date of Patent: Aug. 22, 2006

(54) GEAR WRENCH ALLOWING EASY FORCE APPLICATION

(75) Inventor: Tom Tuanmu, Taichung (TW)

(73) Assignee: Lea Way Hand Tool Corporation, Taichung (TW)

( * ) Notice: Subject to any disclaimer, the term of this patent is extended or adjusted under 35 U.S.C. 154(b) by 0 days.

(21) Appl. No.: 10/462,445

(22) Filed: Jun. 16, 2003

(65) Prior Publication Data

US 2004/0250659 A1 Dec. 16, 2004

(51) Int. Cl.
*B25B 13/46* (2006.01)
*B25B 23/16* (2006.01)

(52) U.S. Cl. ..... 81/63.1; 81/61; 81/177.1

(58) Field of Classification Search ..... 81/63.1, 81/61, 62, 63, 59.1, 177.1, 125.1; D8/17, D8/29

See application file for complete search history.

(56) References Cited

U.S. PATENT DOCUMENTS

| | | | | |
|---|---|---|---|---|
| 2,769,360 | A * | 11/1956 | Woodford et al. | 81/124.3 |
| 4,270,417 | A | 6/1981 | Tesoro | |
| 5,325,744 | A | 7/1994 | Horikawa | |
| 5,394,773 | A * | 3/1995 | Zurbuchen et al. | 76/114 |
| 5,448,932 | A | 9/1995 | Zurbuchen et al. | |
| 5,832,794 | A | 11/1998 | Fowler | |
| 5,865,074 | A * | 2/1999 | Hsieh | 81/124.3 |
| D411,945 | S * | 7/1999 | Chen | D8/28 |
| D413,775 | S * | 9/1999 | Hulsey et al. | D8/22 |
| D465,707 | S * | 11/2002 | Chen | D8/28 |
| D474,381 | S * | 5/2003 | Lee et al. | D8/28 |
| 6,761,092 | B1 * | 7/2004 | Hsien | 81/63.2 |
| 2002/0073527 | A1 | 6/2002 | Satran | |

FOREIGN PATENT DOCUMENTS

| | | |
|---|---|---|
| DE | 29708596 | 7/1997 |
| DE | 19647852 A1 | 5/1998 |
| GB | 2176726 A | 1/1987 |

* cited by examiner

*Primary Examiner*—Lee D. Wilson
*Assistant Examiner*—Alvin J. Grant
(74) *Attorney, Agent, or Firm*—Ladas and Parry LLP

(57) ABSTRACT

A gear wrench allowing easy force application, having: a head, formed with a receiving compartment thereon for receiving a gear ring, the head extending along a first plane; a tail, extending along a second plane; and a neck, provided between and integrally formed with the head and the tail; characterized in that: the first plane is parallel to the second plane, and the neck obliquely extends from the head towards the tail to form a height difference between thee head and the tail. As such, the vertical component of force may be eliminated or minimized so as to effectively reduce occupational hazards; the horizontal component of force may also be increased such that the operator only requires a lower force to effectively tighten or loosen up a fastener.

13 Claims, 8 Drawing Sheets

GEAR WRENCH ALLOWING EASY FORCE APPLICATION

CROSS-REFERENCES TO RELATED APPLICATIONS

Not Applicable

STATEMENT REGARDING FEDERALLY SPONSORED RESEARCH OR DEVELOPMENT

Not Applicable

FIELD OF INVENTION

This invention relates to a wrench, particularly to a gear wrench allowing easy force application.

BACKGROUND OF INVENTION

FIGS. 6A to 6C illustrate a conventional gear wrench with an angle formed between its head and tail, such that its tail inclines upwards with respect to its head. The purpose for providing the inclination is to form a height difference between its tail and open wrenching end to allow easy gripping by an operator. However, such a design fails to meet ergonomics because the operator's hand would need to incline for a certain degree along with the inclined tail.

In addition, due to the inclination of the wrench, when the operator applies a force to cause its head to rotate a fastener (such as bolt), the operator's hand tends to turn the force of application in a horizontal direction so as to result in a vertical component of force Fh and a horizontal component of force Fv. The horizontal component of force Fh will generate a torque along with the wrench to be transmitted to the fastener for tightening or loosening purpose, and is an effective component of force.

However, the vertical component of force Fh is an ineffective component of force and is somewhat hazardous because it may cause the wrench to be lifted up (FIG. 6B) or pressed down (see FIG. 6C). At the same time, in application of the force by the operator, the inclination of the wrench may easily cause change in orientation of vertical component of force. In case the force is not applied to a central axis of the wrench, the vertical component may also cause flipping of the wrench (see FIGS. 6D and 6E). The above phenomena may all cause separation of the gear wrench from the bolt, thereby causing accidents and occupational hazards.

SUMMARY OF INVENTION

In view of human factors, a greater force may be obtained if the force-application plane is parallel to the force-sustaining plane so as to avoid change in orientation of the force application due to inclination.

Hence, it is a primary objective of this invention to provide a gear wrench allowing easy force application that can effectively eliminate or minimize the vertical component of force so as to effectively reduce occupational hazards.

It is another objective of this invention to provide a gear wrench allowing easy force application that can increase the horizontal component of force such that a lower force is required by the operator to effectively tighten or loosen up a fastener.

To achieve the above objectives, the invention provides a gear wrench allowing easy force application having: a head, formed with a receiving compartment thereon for receiving a gear ring, the head extending along a first plane; a tail, extending along a second plane; and a neck, provided between and integrally formed with the head and the tail; characterized in that: the first plane is parallel to the second plane, and the neck obliquely extends from the head towards the tail to form a height difference between the head and the tail.

The structures and characteristics of this invention can be realized by referring to the appended drawings and explanations of the preferred embodiments.

BRIEF DESCRIPTIONS OF DRAWINGS

DETAILED DESCRIPTION OF INVENTION

Figure 1:
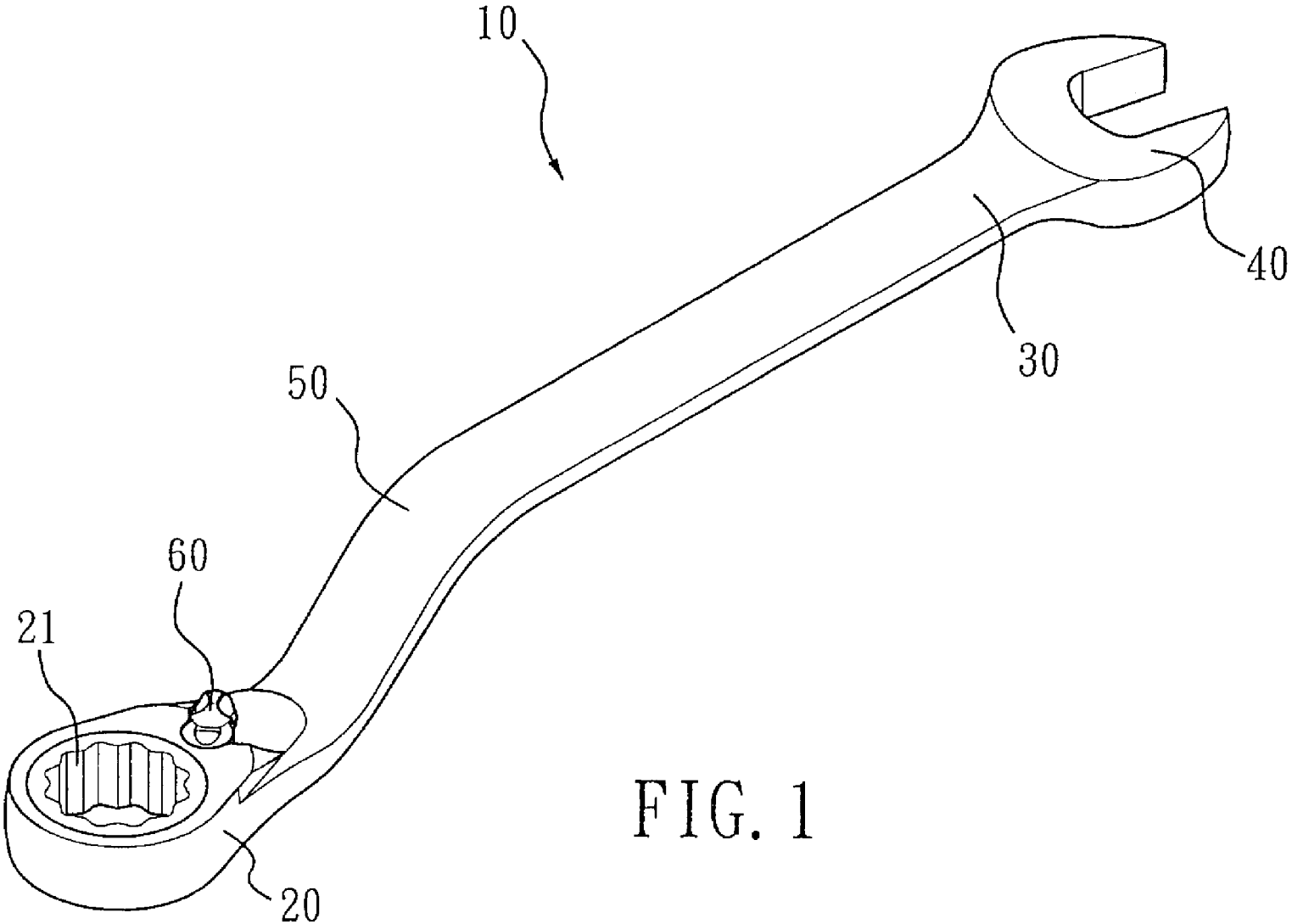
FIG. 1 is a perspective view illustrating a gear wrench allowing easy force application according to this invention.

FIG. 1 illustrates a perspective view of a gear wrench 10 allowing easy force application according to this invention.

With reference to FIG. 1, the gear wrench 10 according to this invention includes: a head 20, a tail 30, a neck 50 formed with the head 20 and the tail 30, and an open wrenching end 40 provided to the tail 30 at an end of the gear wrench 10 opposing the head 20.

The head is formed with a receiving compartment thereon for receiving a gear ring 21 to form a box end.

Figure 2:
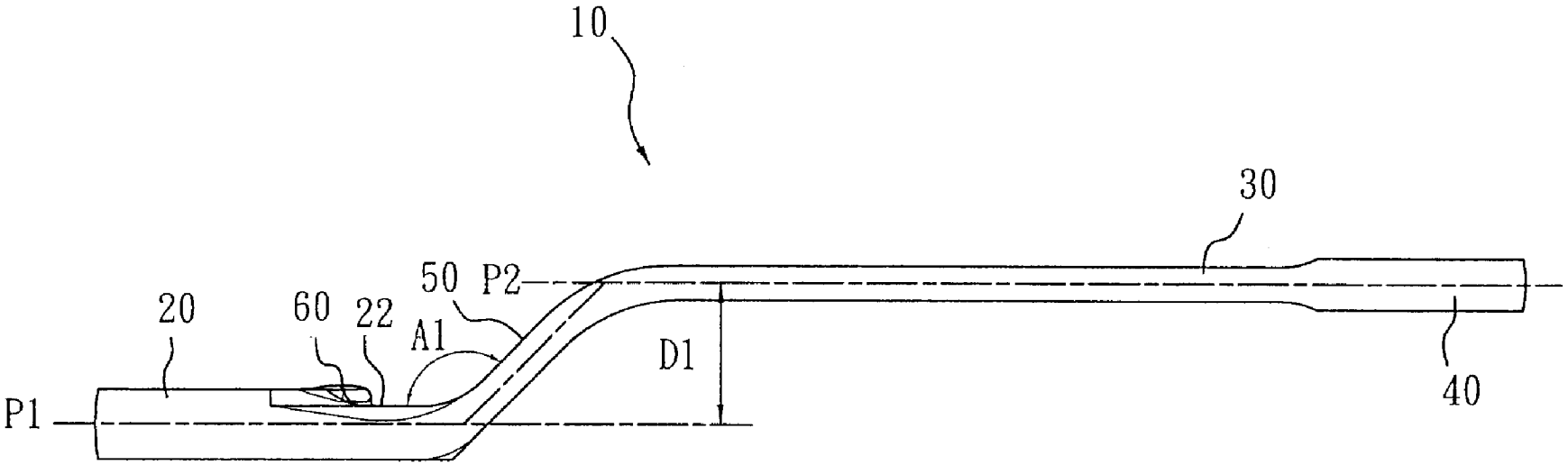
FIG. 2 is a side elevational view of the gear wrench illustrated in FIG. 1.

With reference to FIG. 2, the head 20 extends along a first plane P1 and the tail 30 extends along a second plane P2.

This invention is characterized in that, the first plane P1 is parallel to the second plane P2, and the neck 50 obliquely extends from the head 20 towards the tail 30 to form a height difference D1 between the head 20 and the tail 30.

In practical operation, it is found that it is preferred the height difference D1 formed between the first plane P1 on which the head 20 extends and the second plane P2 on which the tail extends 30 ranges from 12 to 70 mm. In addition, according to the state of use, an angle A1 greater than 90 degrees is formed between the first plane P1 on which the head 20 extends and the neck 50; the angle A1 preferably ranges from 95 to 170 degrees.

Based on this embodiment, the neck 50 would cover part of a grip of the gear wrench 10. The neck 50 is formed with smooth curves at where the neck 50 joins to the head 20 and the tail 30 to reduce corner stress.

According to an embodiment of this invention, the gear wrench 10 is formed at a location neighboring a joint between the head 20 and the neck 50 with an indent 22 and an aperture (not shown) for placement of a direction switch 60. The direction switch 60 co-acts with the gear ring 21 to change the direction in which the gear ring 21 may operate.

The direction switch 60 may adopt a conventional construction. A commonly seen construction includes: a dial, an urging pin, an urging pawl formed with teeth and a spring-biased urging. When an operator dials the direction switch 60, the direction switch 60 will drive the urging pin to pivot, thereby subjecting the urging pawl placed between a gear ring 60 and the gear ring 21 to urge against teeth formed on the gear ring 21 in the direction against which the urging pin urges, for switching the operative direction of the gear wrench 10. Other direction switch construction may also be adopted to achieve the same effect.

Figure 3:
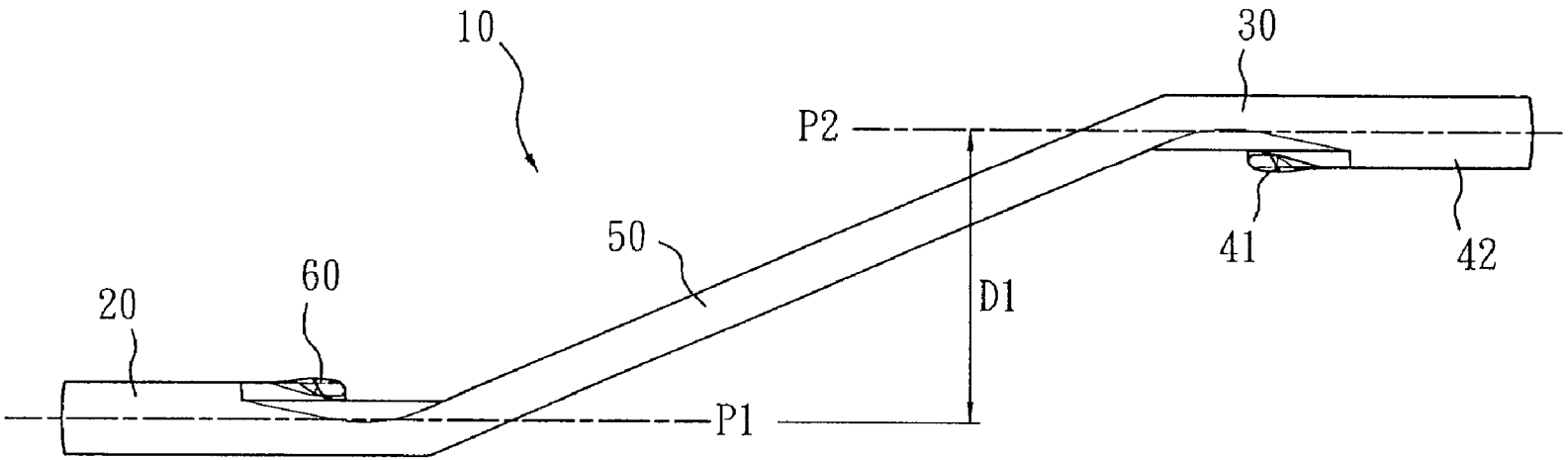
FIG. 3 illustrates an alternative embodiment of the gear wrench allowing easy force application according to this invention.

With reference to FIG. 3, according to an alternative embodiment of this invention, a second box end 42 may also be provided at the end of the tail 30 opposing the head 20. The second box end 42 is further formed with a second compartment thereon for receiving a second gear ring (not shown). The second box end 42 may also be provided with a second direction switch 41 which co-acts with the second gear ring to change the direction in which the second gear ring may operate. According to this embodiment, the neck 50 covers the entire grip of the gear wrench 10. The neck 50, however, is still formed with smooth curves at where the neck 50 joins to the head 20 and the tail 30 to reduce corner stress.

Figure 4:
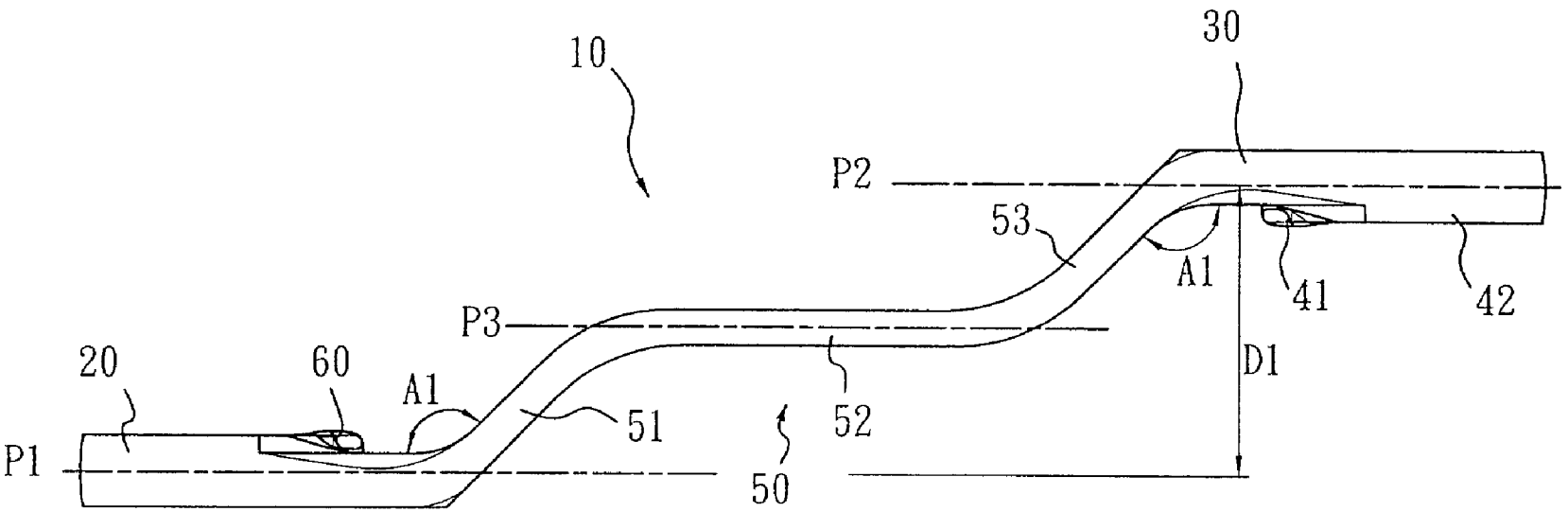
FIG. 4 illustrates a further embodiment of the gear wrench allowing easy force application according to this invention.
Figure 5:
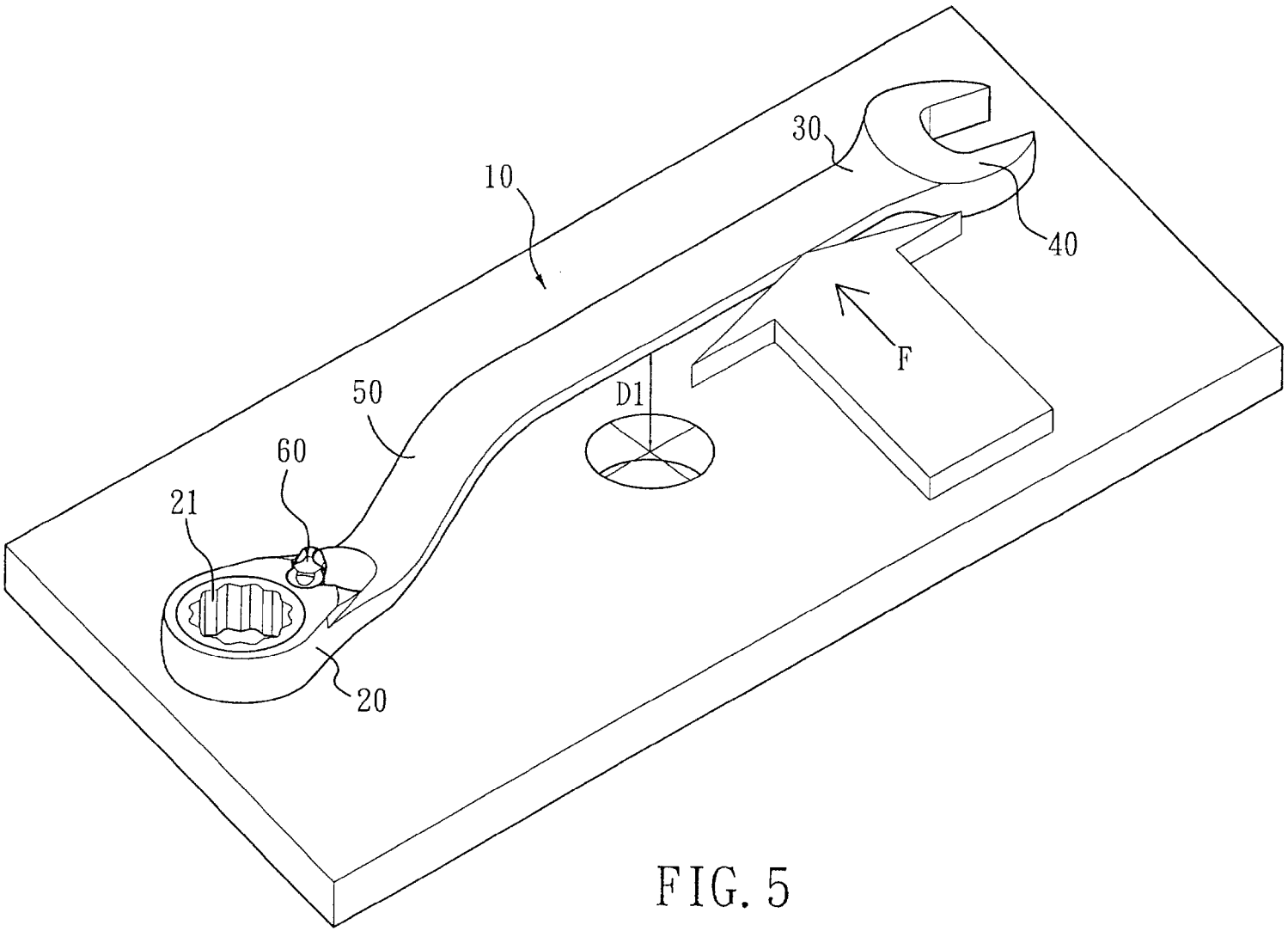
FIG. 5 illustrates the distribution of the horizontal component of force of the gear wrench allowing easy force application according to this invention.
Figure 6A:
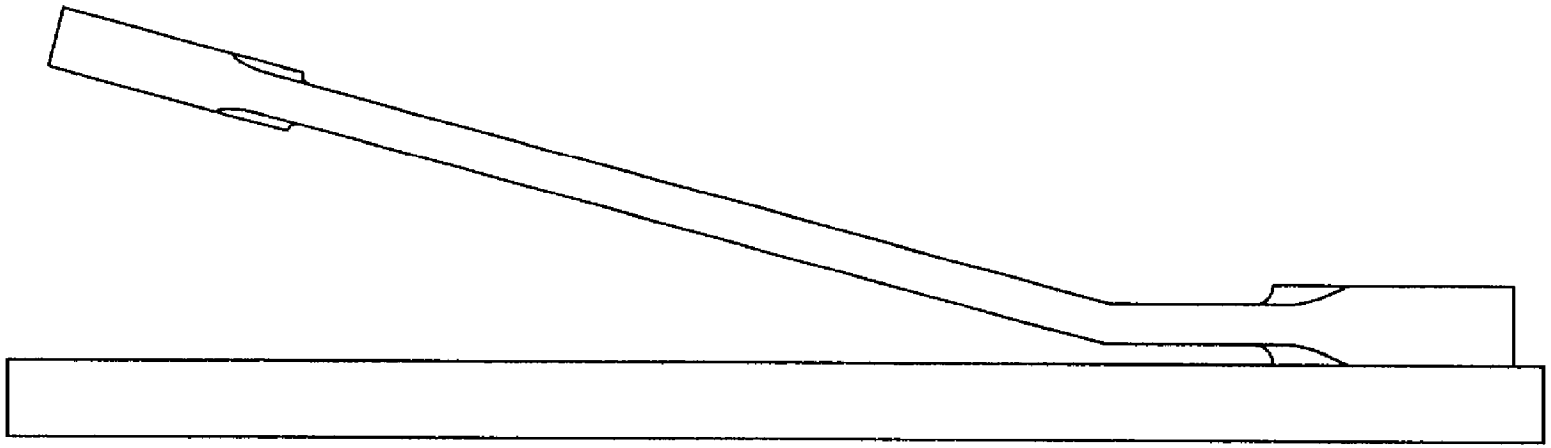
FIG. 6A (PRIOR ART)
FIG. 6A is a side elevational view of a conventional gear wrench.
Figure 6B:
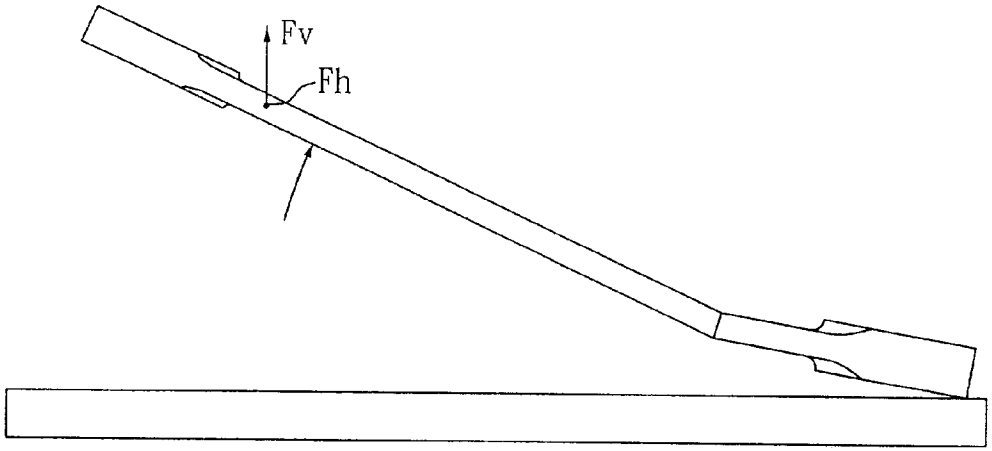
FIG. 6B (PRIOR ART)
FIGS. 6B to 6E illustrate the phenomena of the gear wrench illustrated in FIG. 6A being improperly pressed down, lifted up or flipped.
Figure 6C:
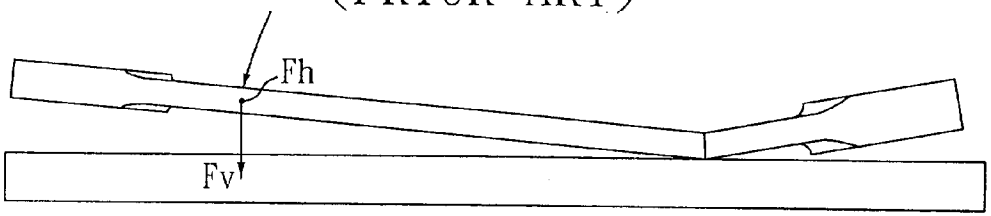
FIG. 6C (PRIOR ART)
Figure 6E:
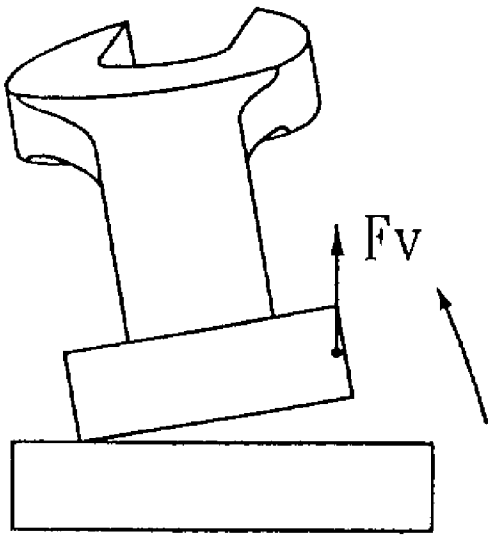
FIG. 6E (PRIOR ART)
Figure 6D:
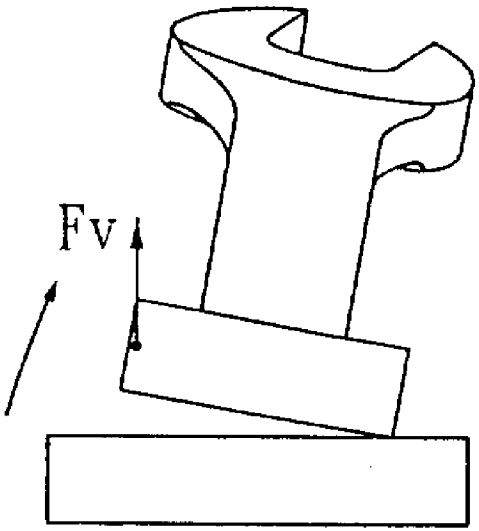
FIG. 6D (PRIOR ART)

With reference to FIG. 4, according to this invention, part of the neck 50 may also extend along a third plane P3, which is parallel to the first plane P1 and the second plane P2. According to this embodiment, the neck 50, between the head 20 and the tail 30, is jointly constructed by an inclined first neck portion 51, a second neck portion 52 extending along the third plane P3 and an inclined third neck portion 53. Preferably, a height difference D1 ranging from 12 to 70 mm is still maintained between the first plane P1 and the second plane P2. In addition, according to the state of use, an angle A1 greater than 90 degrees is formed between the first plane P1 on which the head 20 extends and the first neck portion 51 as well as between the third neck portion 53 and the second plane P2 on which the tail 30 extends; the angle A1 preferably ranges from 95 to 170 degrees.

According to this invention, the double curves formed between the tail and the head 20 not only maintains a height difference D1 to allow easy gripping by an operator, but also eliminates the operator's tendency to turn his/her hand in a horizontal direction, such that the force-application plane (P2) is always parallel to the force-sustaining plane (P1) so as to result in a greater force. In other words, the sophisticated transmission of the force through the curves ensures the force applied by the operator to be equal to the horizontal component of force Fh, while minimizing or reducing the vertical component of force Fv due to tendency to turn, found in prior gear wrenches. As such, the phenomena of improperly lifting, pressing or flipping of the gear wrench that cause separation of the gear wrench from the bolt and ultimately cause accidents and occupational hazards, may be prevented.

This invention is related to a novel creation that makes a breakthrough in the art. Aforementioned explanations, however, are directed to the description of preferred embodiments according to this invention. Various changes and implementations can be made by persons skilled in the art without departing from the technical concept of this invention. Since this invention is not limited to the specific details described in connection with the preferred embodiments, changes to certain features of the preferred embodiments without altering the overall basic function of the invention are contemplated within the scope of the appended claims.

NOMENCLATURE LISTING

A1 angel
D1 height difference
Fh horizontal component of force
Fv vertical component of force
P1 first plane
P2 second plane
P3 third plane
10 gear wrench
20 head
21 gear ring
22 indent
30 tail
40 open wrenching end
41 second direction switch
42 second box end
50 neck
51 first neck portion
52 second neck portion
53 third neck portion
60 direction switch

What is claimed is:

1. In a gear wrench allowing easy force application, the improvements comprising:

a head (20) with a receiving compartment thereon for receiving a gear ring, the head extending along a first plane;

a tail (30) extending along a second plane;

a neck (50) between and integrally joining the head and the tail; and a box end (42) at an end of the neck opposing the head (20), whereby the box end and tail allow a hand of a user to easily hold and exert a force on the gear wrench with minimized or eliminated vertical component;

characterized in that the first plane is parallel to the second plane, the neck obliquely extends from the head towards the tail to form a height difference between the head and the tail, the neck is formed with smooth curves where the neck joins to the head and the tail, and a portion of a grip shares one of the first and second planes.

2. The gear wrench according to claim 1, wherein the head and the neck are formed with an angle greater than 90 degrees therebetween.

3. The gear wrench according to claim 1, wherein the head and the neck are formed with an angle ranging from 95 to 170 degrees therebetween.

4. The gear wrench according to claim 1, wherein the height difference ranges from 12 to 70 mm.

5. The gear wrench according to claim 4, further comprising: a direction switch provided on the head and co-acting with the gear ring to change the direction in which the gear ring operates.

6. A gear wrench allowing easy force application, comprising:

a head (20), formed with a receiving compartment thereon for receiving a gear ring, the head extending along a first plane;

a tail (30) extending along a second plane;

a second box end (42) at an end of the gear wrench opposing said head (20); and a neck (50), provided between and integrally formed with the head and the tail;

characterized in that: the first plane is parallel to the second plane, and the neck obliquely extends from the head towards the tail to form a height difference between the head and the tail; the neck is formed with smooth curves at where the neck joins to the head and the tail; and the neck includes a part extending along a third plane parallel to the second plane; and in that said second box end and said tail allow a hand of a user to easily hold and exert a force on said gear wrench without vertical component of said force or with minimized vertical component of said force.

7. The gear wrench according to claim 4, wherein the tail includes an open wrenching end an end of the gear wrench opposing the head.

8. The gear wrench according to claim 6, further comprising: a second direction switch provided to the second box end and co-acting with the gear ring to change the direction in which the second gear ring operates.

9. The gear wrench according to claim 6, wherein the head and the neck are formed with an angle greater than 90 degrees therebetween.

10. The gear wrench according to claim 6, wherein the head and the neck are formed with an angle ranging from 95 to 170 degrees therebetween.

11. The gear wrench according to claim 6, wherein the height difference ranges from 12 to 70 mm.

12. The gear wrench according to claim 11, further comprising: a direction switch provided on the head and co-acting with the gear ring to change the direction in which the gear ring operates.

13. The gear wrench according to claim 11, wherein the tail includes an open wrenching end and end of the gear wrench opposing the head.

* * * * *